US005567907A

United States Patent [19]

Westfall

[11] Patent Number: 5,567,907

[45] Date of Patent: Oct. 22, 1996

[54] FIREWORKS SUPPORT APPARATUS

[76] Inventor: Thomas C. Westfall, 518 Ohio, Kansas City, Kans. 66101

[21] Appl. No.: 293,306

[22] Filed: Aug. 22, 1994

[51] Int. Cl.[6] ..... F42B 4/26

[52] U.S. Cl. ..... 102/344; 102/349; 102/358; 102/361

[58] Field of Search ..... 102/343, 344, 102/361, 347, 349, 358

[56] References Cited

U.S. PATENT DOCUMENTS

| | | | |
|---|---|---|---|
| 575,711 | 1/1897 | Haley | 248/121 |
| 1,776,354 | 9/1930 | Edmands | 126/30 |
| 2,103,936 | 12/1937 | Decker | 102/343 X |
| 2,220,407 | 11/1940 | Joss | 246/488 |
| 3,034,752 | 5/1962 | Pazmany | 248/54 |
| 3,283,717 | 11/1966 | Balch | 102/37.8 |
| 3,844,557 | 10/1974 | Pompetti | 273/86 R |
| 3,855,710 | 12/1974 | Lunden | 102/37.4 |
| 4,690,029 | 9/1987 | Katzmann et al. | 86/20.11 |
| 4,724,768 | 2/1988 | Robinson et al. | 102/349 |
| 4,771,695 | 9/1988 | Simpson | 102/343 |
| 4,896,651 | 1/1990 | Kott, Jr. | 126/30 |
| 4,917,015 | 4/1990 | Lowery | 102/342 |
| 5,249,528 | 10/1993 | Lee | 102/361 |
| 5,339,741 | 8/1994 | Craven et al. | 102/361 |
| 5,390,581 | 2/1995 | Hiltz et al. | 89/1.812 |

FOREIGN PATENT DOCUMENTS 8203561 9/1932 Germany .

*Primary Examiner*—Peter A. Nelson

*Attorney, Agent, or Firm*—Hovey, Williams, Timmons & Collins

[57] ABSTRACT

A fireworks support apparatus broadly includes a fireworks support assembly and a positioning assembly. The support assembly includes a launching member, support structure, and at least one elastomeric band. The launching member, configured for receiving at least one elongated pyrotechnic device, presents a closed lower end and an open upper end, and includes a retaining collar, retaining nut, and a friction band. The support structure presents a support face, having positioning slots for positioning the elastomeric bands, and an opening defined therein for receiving the open upper end of the launching member. The support structure is secured to the launching member by receiving the open upper end of the launching member through the opening, the support structure being retained between the retaining collar and retaining nut. The elastomeric bands, configured for retaining at least one mortar-type pyrotechnic device, or other similar projectile-type pyrotechnic device having a base, to the support face, are wrapped around the support structure and placed adjacent to the positioning slots. The positioning assembly is configured for positioning the support face above a support level and includes a support stake having a lower portion configured for penetrating the earth, and an elongated support member configured for rigidly coupling with the support stake at one end and the launching member of the support assembly at the other end.

14 Claims, 1 Drawing Sheet

FIREWORKS SUPPORT APPARATUS

BACKGROUND OF THE INVENTION

1. Field of the Invention

The present invention relates to pyrotechnic devices, and, more particularly, to an apparatus for rigidly supporting pyrotechnic devices, such as mortar-type, rocket-type, projectile-type, and other pyrotechnic devices, commonly referred to as fireworks, during ignition, so that the pyrotechnic devices may be more safely used to minimize harm to caused to persons and the environment surrounding the pyrotechnic devices.

2. Discussion of the Prior Art

It is known to provide pyrotechnic devices, commonly referred to as fireworks, having a base and a long burning fuse. A person may place such a pyrotechnic device on a relatively flat area of ground, light the fuse of the pyrotechnic device, and have enough time to quickly move to a safe distance from the pyrotechnic device before ignition occurs. Such bases provide a relatively sturdy support for the pyrotechnic device when placed on a relatively flat area of ground. However, such bases usually keep the pyrotechnic devices close to the ground, which may result in causing a fire, especially when such pyrotechnic devices are used over areas of ground that are covered with grass, brush or other easily combustible material.

It is also known to provide a hand-held wire clamping device which a person may utilize to hold an ignited pyrotechnic device away from the person's body while the pyrotechnic device is discharging. For example, such a clamp may be used to hold an elongated projectile-type pyrotechnic device, commonly referred to as a Roman candle, away from the person's body during ignition. However, there exist many pyrotechnic devices which shoot sparks and flames, or do not have a sufficient area for clamping. These types of pyrotechnic devices are ill-suited for use with such a clamping device.

Therefore, a significant, and, heretofore, unsolved need exists to provide a fireworks support apparatus that is capable of being a stable structure which may be used on a plurality of surfaces, such as dirt, grass, shallow water, rough, uneven, and sloping surfaces, and from which a plurality of types of pyrotechnic devices, such as rocket-type, mortar-type, projectile-type, and other types of pyrotechnic devices, may be safely ignited and discharged without causing harm to persons or the surrounding environment.

SUMMARY OF THE INVENTION

In accordance with the invention, a fireworks support apparatus is provided comprising a fireworks support assembly including a launching member with a closed lower end and an open upper end configured for receiving at least one elongated pyrotechnic device, and a support structure having a fireworks support face; means for positioning the support face above a support level provided by a support stake with a lower portion configured for penetrating the earth, and an elongated support member configured for coupling with the support stake at one end and further coupling with the launching member at the other end; and at least one elastomeric band in a spanning relationship with at least a portion of the support face configured for retaining at least one pyrotechnic device in supportive engagement with the support face.

The support face is positioned in a three step process. First, the lower end of the support stake is placed adjacent to the earth and the support stake is firmly implanted into the earth with a portion remaining above the surface. Next, the elongated support member is coupled with the support stake. Finally, the support structure is attached by coupling the launching member with the elongated support member.

The launching member is removably coupled with the elongated support member and is light weight so that the fireworks support assembly may be conveniently hand held by grasping the launching member. The hand held configuration may be chosen when rocket-type or projectile-type pyrotechnic devices, and other type of pyrotechnic devices which shoot showers of sparks and flame, are used. The support face acting as a shield against the showers of sparks and flame.

The hand held configuration gives the fireworks support apparatus the additional benefit of allowing removal of the support structure so that fresh pyrotechnic devices may be attached to the support face or received into the launching member away from launching site where the support stake and elongated support member remain. This feature allows pyrotechnic devices to be loaded more easily, and promotes safety by making it a simple task to remove the support structure between usages for the purpose of loading thereby encouraging the practice of keeping fresh pyrotechnic devices a safe distance away from the launching site to avoid accidental ignition and discharge.

BRIEF DESCRIPTION OF THE DRAWING FIGURES

A preferred embodiment of the fireworks support apparatus of the present invention is described in detail below with reference to the attached figures, wherein.

DETAILED DESCRIPTION OF THE PREFERRED EMBODIMENT

Figures 1, 2, 3:
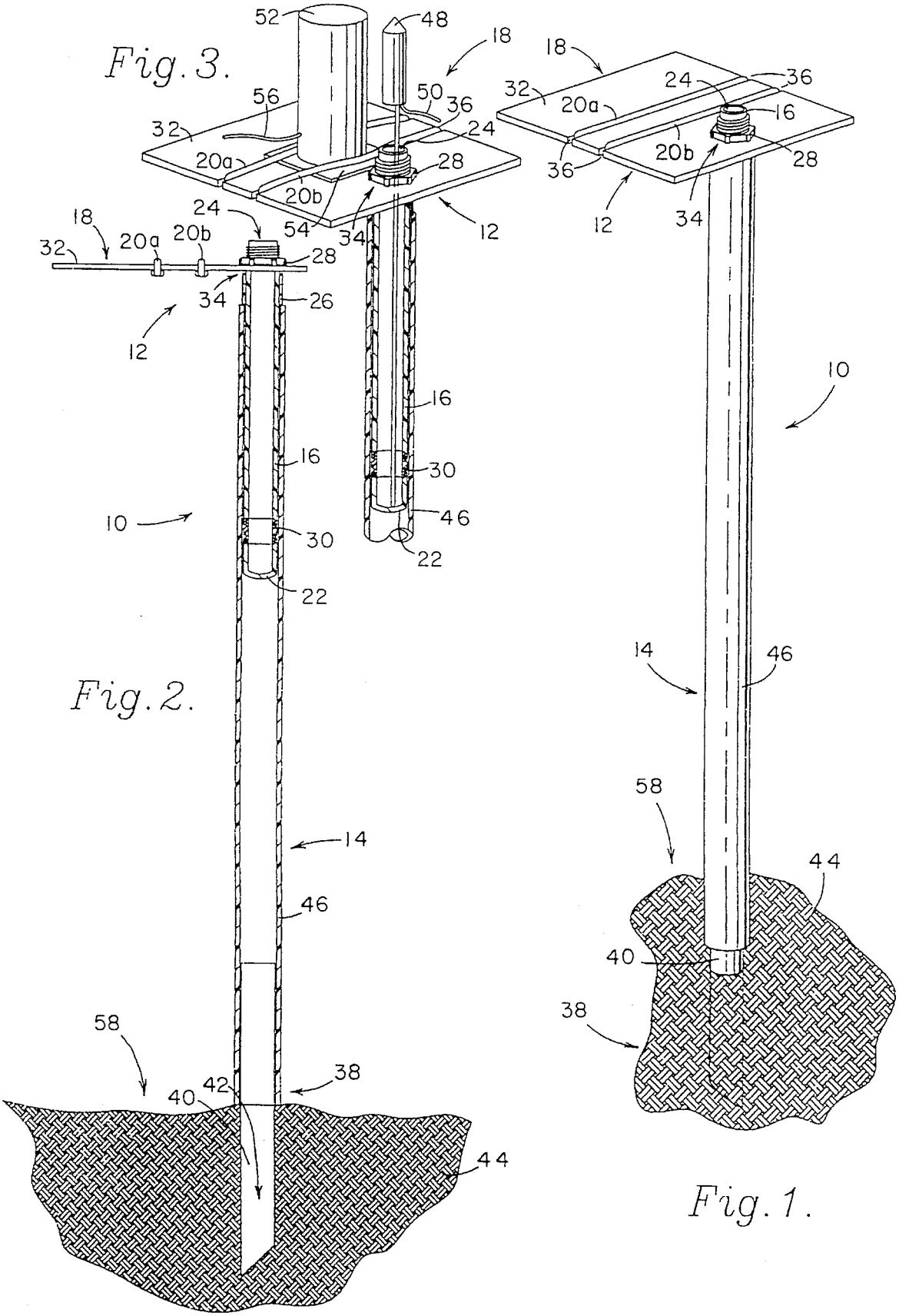
FIG. 1 is a perspective view of a fireworks support apparatus constructed in accordance with the preferred embodiment showing a portion implanted in the earth.
FIG. 2 is a side elevational view in partial section of the fireworks support apparatus of FIG. 1.
FIG. 3 is a partial perspective view in partial section of the fireworks support assembly including a support structure of a fire works support apparatus depicting a mortar-type pyrotechnic device retained to the support face by a pair of elastomeric bands, and a rocket-type pyrotechnic device resting in the launching member.

FIG. 1 illustrates fireworks support apparatus 10 constructed in accordance with a preferred embodiment of the present invention. Apparatus 10 broadly includes fireworks support assembly 12 and positioning assembly 14. Support assembly 12 includes launching member 16, support structure 18 and elastomeric bands 20*a* and 20*b*.

Tubular launching member 16 is preferably composed of polyvinylchloride (PVC) pipe, and presents closed lower end 22, exteriorly threaded, open upper end 24, and includes retaining collar 26, retaining nut 28 and friction band 30.

Support structure 18 is preferably composed of ¼" plywood and presents a generally square configuration defining support face 32 with opening 34 defined therethrough adjacent one side for receiving open upper end 24 of launching member 16 therethrough. FIG. 2 illustrates support structure 18 secured to launching member 16 by threadably coupling retaining collar 26 with open upper end 24 of launching member 16 spaced from open upper end 24, open upper end 24 of launching member 16 then being received through opening 34 in support face 32, and retaining nut 28 threadably coupled with open upper end 24 of launching member 16, support structure 18 secured between retaining collar 26 and retaining nut 28.

Support structure 18 further defines positioning slots 36 configured for securing elastomeric bands 20*a* and 20*b* to support structure 18. For example, the figures illustrate four slots 36 and two elastomeric bands 20*a* and 20*b* in a spanning relationship with at least a portion of support face 32.

Elastomeric bands 20*a* and 20*b* are preferably composed of an elastomeric material, and wrapped in a woven material, such bands 20*a* and 20*b* commonly referred to as bungee cords. Elastomeric bands 20*a* and 20*b* are sufficiently large so that bands 20*a* and 20*b* may be forcibly stretched for wrapping around the support structure 18. Elastomeric bands 20*a* and 20*b* may be forcibly stretched by a person, or other like means. When the stretching force is removed, elastomeric bands 20*a* and 20*b* return towards the normal size, therefore, by placing bands 20*a* and 20*b* adjacent to slots 36, bands 20*a* and 20*b* fit to the slots 36 and are thus secured in the aforementioned spanning relationship with at least a portion of support face 32.

Alternatively, one elastomeric band may be positioned to provide sufficient retentive capability where the one band is in a spanning relationship with support face 32, the ends of the one band being placed adjacent slots 36.

Positioning assembly 14 is configured for positioning support face 32 above support level 38, and includes support stake 40 having lower portion 42 configured for penetrating earth 44, and tubular elongated support member 46 removably couples with support stake 40 at one end and launching member 16 at the other end.

The interior diameter of tubular elongated support member 46 is slightly smaller than the exterior diameter of support stake 40, therefore, support member 46 rigidly couples with support stake 40. A rigid coupling may also be attained by including an expansion slot in the side wall of elongated support member 46 for pressure fitting support stake 40 into elongated support member 46, or by wrapping a friction band around the exterior diameter of the support stake 40.

Support face 32 is positioned above support level 38 in a three step process. First, lower portion 42 of support stake 40 is placed adjacent to earth 44, support stake 40 is then forcibly pounded by a hammer, or the like, and implanted into earth 44 with an upper portion of support stake 40 remaining exposed. Next, elongated support member 46 is coupled with support stake 40. Finally, support assembly 12 is attached by coupling launching member 16 with elongated support member 46.

The interior diameter of tubular elongated support member 46 is slightly smaller than the exterior diameter of the launching member 16 and friction band 30 is positioned around closed lower end 22 of launching member 16, thereby providing a rigid fit between launching member 16 and support member 46. A rigid fit may also be attained by including an expansion slot in the side wall of the elongated support member 46.

In use, fireworks support apparatus 10 provides a structure from which any of a plurality of pyrotechnic devices may be safely ignited. For example, as illustrated in FIG. 3, an elongated pyrotechnic device, such as rocket-type pyrotechnic device 48, may be received by open upper end 24 of launching member 16, and supported by closed lower end 22. Rocket-type pyrotechnic device 48, or another elongated pyrotechnic device, safely rests in the launching member 16 after fuse 50 has been lit, but prior to ignition and discharge.

FIG. 3 further illustrates mortar-type pyrotechnic device 52 having base 54 being retained to support face 32 by elastomeric bands 20*a* and 20*b* clamping base 54 to support face 32.

Fireworks support apparatus 10 is configured for launching pyrotechnic devices in a stationary form where support stake 40 has been implanted in earth 44, elongated support member 46 rigidly coupled with support stake 40 and support assembly 12 secured to elongated support member 46 by rigidly coupling launching member 16 with elongated support member 46.

The stationary configuration may be selected when mortar-type pyrotechnic devices 52 are used, such mortar-type pyrotechnic devices 52 requiring placement on a relatively flat and solid surface, and further requiring that the person lighting fuse 56 has sufficient time to move to a safe distance from mortar-type pyrotechnic device 52 and apparatus 10 before ignition occurs. FIG. 3 illustrates elastomeric bands 20*a* and 20*b* retaining base 54 of mortar-type pyrotechnic device 52. The stationary configuration may also be selected when a predetermined flight path for rocket-type pyrotechnic devices 48 is desired.

Alternatively, a person may remove support assembly 12 and grasp launching member 16 of support structure 18. This hand held configuration provides several functions. First, rocket-type pyrotechnic devices 48, such as those commonly referred to as bottle rockets, may be ignited from launching member 16 in the hand held configuration, support structure 18 being sufficiently large so as to provide protection for the person holding support assembly 12 from burns which might otherwise result from the showers of sparks and flame being discharged from the pyrotechnic devices. This configuration is also useful when elongated projectile-type pyrotechnic devices, such as Roman candles, are used.

Second, the hand held configuration allows support assembly 12 to be removed from positioing assembly 14 so that discharged pyrotechnic devices may be removed and fresh pyrotechnic devices may be loaded. The ease with which support assembly 12 may be removed from elongated support member 46 encourages the keeping of the fresh pyrotechnic devices a safe distance from launching site 58 so that the fresh pyrotechnic devices do not accidentally ignite.

Fireworks support apparatus 10 is not limited to being constructed of any one material as long as fireworks support apparatus 10 is sufficiently strong so as to maintain its shape over time, through handling and repeated use, and exposure to natural destructive elements such as heat and sunlight.

Although the invention has been described with reference to the illustrated preferred embodiment, it is noted that variations and changes may be made and equivalents employed herein without departing from the scope of the invention as recited in the claims.

I claim:

1. A fireworks support apparatus comprising:

a fireworks support assembly including a support structure having a fireworks support face;

means for positioning said support face above a support level; and at least one elastomeric band positioned adjacent said support face in a spanning relationship with at least a portion of said support face, said band being configured for retaining at least one pyrotechnic device between said band and support face while elastomerically stretched.

2. The fireworks support apparatus as set forth in claim 1, said fireworks support assembly including a launching member having a closed lower end and an open upper end configured for receiving an elongated pyrotechnic device, said support face including an opening defined therein for receiving said launching member open end, and means for coupling said launching member and said support structure with said open end received through said opening.

3. The fireworks support apparatus as set forth in claim 2, said launching member presenting a tubular configuration and including threads defined in the outer surface thereof adjacent said open end, said means for coupling including a retaining collar coupled with said launching member and spaced from said open end, and a retaining nut threadably coupled with said launching member adjacent said open end with said support structure therebetween.

4. The fireworks support apparatus as set forth in claim 3, said means for positioning said support face includes a support stake having a lower portion configured for penetrating into the earth, an elongated support member, means for engaging said elongated support member with said support stake, said support stake having been firmly implanted into earth, and means for engaging said launching member with said elongated support member.

5. The fireworks support apparatus as set forth in claim 4, said means for engaging said elongated support member with said support stake includes said support stake presenting a cylindrical outer surface, said elongated support member presenting a tubular configuration having openings at both ends for slidably receiving said support stake.

6. The fireworks support apparatus as set forth in claim 5, said means for engaging said launching member with said elongated support member includes said elongated support member slidably receiving said launching member.

7. The fireworks support apparatus as set forth in claim 6, further including a plurality of said elastomeric bands positioned adjacent said support face in a spanning relationship with at least a portion of said support face configured for retaining at least one pyrotechnic device in supportive engagement with said support face.

8. The fireworks support apparatus as set forth in claim 7, said plurality of said elastomeric bands are positioned substantially parallel relative to each other.

9. The fireworks support apparatus as set forth in claim 6, further including a pair of said elastomeric bands positioned substantially parallel with each other and adjacent said support face in a spanning relationship with at least a portion of said support face configured for retaining at least one pyrotechnic device in supportive engagement with said support face.

10. A fireworks support apparatus comprising:

a fireworks support assembly including a launching member and a support structure having a fireworks support face; and means for positioning said support face above a support level, said means for positioning said support face including an elongated, tubular support member configured for removably coupling with said launching member, said launching member presenting a tubular configuration and having a closed lower end and an open upper end configured for receiving an elongated pyrotechnic device having a fuse and for positioning the fuse above said upper end, said support face including an opening defined therein for receiving said launching member, there being means for coupling said launching member and said support structure with said open end received through said opening, said means for positioning including means for positioning said support member upright relative to a support surface, said support member being configured for slidably and removably receiving and supporting said launching member lower end and thereby said support assembly therein.

11. The fireworks support apparatus as set forth in claim 10, said means for positioning said support face further includes a support stake having a lower portion configured for penetrating into the earth.

means for engaging said elongated support member with said support stake, said support stake having been firmly implanted into earth, and means for removably engaging said launching member with said elongated support member.

12. The fireworks support apparatus as set forth in claim 11, said means for engaging said elongated support member with said support stake includes said support stake presenting a cylindrical outer surface, said elongated support member presenting a tubular configuration having openings at both ends for slidably receiving said support stake.

13. The fireworks support apparatus as set forth in claim 10, said support face having at least one elastomeric band in a spanning relationship with at least a portion of said support face configured for retaining at least one pyrotechnic device in supportive engagement with said support face.

14. The fireworks support apparatus as set forth in claim 13, said support face having a pair of substantially parallel elastomeric bands in a spanning relationship with at least a portion of said support face configured for retaining at least one pyrotechnic device in supportive engagement with said support face.

* * * * *